United States Patent [19]

Tann

[11] 3,993,197

[45] Nov. 23, 1976

[54] LINE TENSIONING DEVICE

[76] Inventor: Walter Tann, 60-68 69th Ave., Ridgewood, N.Y. 11227

[22] Filed: Jan. 15, 1976

[21] Appl. No.: 649,486

[52] U.S. Cl. ..... 211/119.09; 211/119.15; 254/72

[51] Int. Cl.[2] ..... D06F 53/00

[58] Field of Search ..... 211/119.09, 119.15; 24/68–71.1; 256/37; 254/72, 198; 74/575, 577 R, 577 S, 577 FS; 292/153

[56] References Cited

UNITED STATES PATENTS

| | | | |
|---|---|---|---|
| 79,801 | 7/1868 | Adams | 292/153 |
| 81,367 | 8/1868 | Hayden | 211/119.15 X |
| 322,460 | 7/1885 | Long | 24/68 CT |
| 580,704 | 4/1897 | Nelson | 24/68 CT |
| 984,604 | 2/1911 | Rantine | 211/119.09 |
| 987,015 | 3/1911 | Rantine | 211/119.09 |
| 1,003,907 | 9/1911 | Hoffman | 24/68 B |
| 1,342,625 | 6/1920 | Farris | 254/72 |
| 1,360,846 | 11/1920 | Williams | 211/119.15 |

*Primary Examiner*—Roy D. Frazier
*Assistant Examiner*—Terrell P. Lewis
*Attorney, Agent, or Firm*—Philip D. Amins

[57] ABSTRACT

This disclosure pertains to a line tensioning device adapted to automatically tension a line fastened to an arm. The arm alternately engages outwardly spring biased rows of cams disposed on an upper and lowermost edge of a beam member which inturn is secured at one free end to a supporting structure. The upper row of cams are disposed in spaced apart relationship to the lower row of cams. As the line decreases the tensioning forces on the arm, the arm changes its angular relationship with the axis of the beam member permitting the arm to engage cams more closely located to the supported end of the beam member, maintaining the tensioning forces in the line thereby.

18 Claims, 6 Drawing Figures

LINE TENSIONING DEVICE

BACKGROUND OF THE INVENTION

1. The Field Of The Invention

This invention relates to line tightening devices, and more particularly, to that class adapted to automatically provide tensioning forces to endless lines and to the free end of a non-endless line.

2. Description Of The Prior Art

The prior art includes a variety of methods adapted to increase the tensioning forces in clothes lines. U.S. Pat. No. 987,015 issued Mar. 14, 1911 to D. W. Rantine teaches a device tensioning an endless clothes line utilizing a beam adapted with a plurality of fixed cams on the uppermost surface thereof. An arm selectively engages a cam at one end supporting a clothes line pulley at the other end thereof. The user manually displaces the arm towards the supported end of the beam increasing the tension in the line thereby. U.S. Pat. No. 3,163,903issued Jan. 5, 1965 to F. R. Knaebe discloses a beam member adapted to be supported at one end, having a lateral line gripping surface parallel to the longitudinal axis of the beam. An opposing line grasping surface is secured to the beam utilizing a slot displaced angularly downwardly towards the line gripping surface. The line gripping surface tends to bind the line as the line tension increases. The free end of the line, however, may be pulled taut manually, easily overcoming the binding forces securing the line between the line gripping and line grasping surfaces. Both of the aforementioned patents require manual manipulation to increase the tension in the line. U.S. Pat. No. 1,096,662 issued May 12, 1914 to S. Zimmermann shows a pulling jack adapted to increase the tension in the line utilizing two rows of holes disposed along a beam member. Pins are selectively inserted in the holes providing a pivot point about which a manually operated arm may be pivoted. The jack increases the tension between a line fastened to one end of the beam and a line fastened to the arm intermediate the two rows of holes. This disclosure permits the increase in the tension between the lines in discreet steps manually obtained by the manipulation of the arm.

SUMMARY OF THE INVENTION

A primary object of the present invention is to provide a line tensioning device which automatically takes up the slack in a line whose length varies due to thermal expansion and contraction or a change in other load forces exerted upon the line.

Another object is to provide a line tensioning device which can be manually operated to tighten the line utilizing a single force applied in a single direction.

Still another object is to provide a line tensioning device which can be utilized with endless lines as well as securing the free end of a single line.

Yet another object is to provide a line tensioning device which can be operated to release line tension without requiring tools.

A further object is to provide a line tensioning device which allows the line engaging arm thereof to apply ever increasing line tensioning forces by automatic relocation of the arm along the supporting beam portion thereof dependent upon line tautness.

Another object is to provide a line tensioning device which can be operated manually to increase line tautness without the need for tools.

Still another object is to provide a line tensioning device which is adapted to have the line engaging portion fastened to the line independent of the supporting portion thereof.

Lines strung between two supporting structures tend to sag or tighten due to thermal expansion or contraction or changes in externally applied forces exerted on the line. This disclosure pertains to a line tensioning device which automatically responds to these changes in such a manner as to sense the decrease in line tension, enabling an arm to which one end of the line is affixed, to alternatively change its angular relationship to a supported beam so as to selectively engage two rows of cams affixed to the beam. As the arm pivots about a cam engaging pin projecting therefrom that is in contact with a cam in a first row of cams, a second cam engaging pin alternatively disengages from a cam in a second row of cams, and moves towards an adjacent cam in the second row. If the line tension is sufficiently reduced, the second cam engaging pin engages the adjacent cam. Alternate relaxations and tensioning experienced by the line causes the arm to walk along the beam, in stepwise fashion, from cam to cam allowing the arm to automatically assume a location closer to the supported end of the beam which in turn maintains the tension in the line in a fashion responsive to changes in the tension in the line due to thermal or otherwise applied forces. The arm may be manually shifted towards the supported end of the beam so as to engage selected cams at a desired location. Alternatively, the arm may be positioned away from the supported end of the beam by bypassing cams more closely located to the supported end of the beam and engaging a pair of cams adjacent the free end of the beam.

These objects, as well as other objects of the invention, will become readily apparent after reading the following description of the accompanying drawings.

DESCRIPTION OF THE PREFERRED EMBODIMENT

Figure 1:
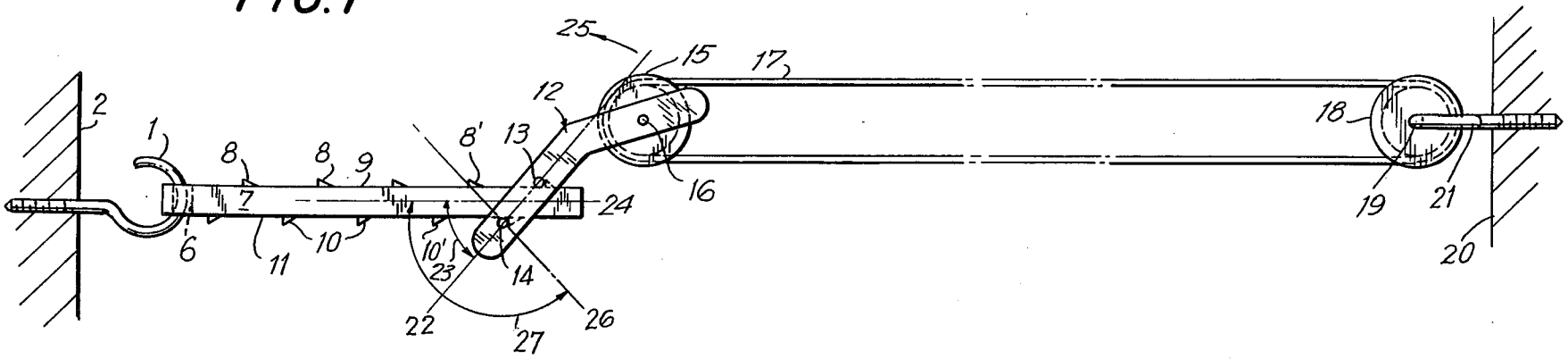
FIG. 1 is a front elevation view of the line tensioning device illustrating an endless line shown secured between two spaced apart supported structures.

The structure and method of fabrication of the present invention is applicable to a beam structure adapted with a first row of equispaced cams projecting upwardly from an uppermost edge thereof and a second row of equispaced cams projecting downwardly from a lowermost edge. The cams in the first row are disposed in spaced apart relationship with the cams in the second row. A hole is located in one end of the beam enabling an eye hook to be inserted therein so that the beam may be secured to a vertical supporting surface, or if desired, to the free end of a supporting line.

Each cam is pivotably secured to the beam and utilizes a spring to force a portion of the cam to project outwardly therefrom. The edge of the cam that is closest to the supported end of the beam that projects outwardly from the surface of the beam, has a portion thereof forming a right angle to the longitudinal axis of the beam. The cam is pivoted along a pivot axis such that the vertical surface is intermediate the supported end of the beam and the cam pivot axis. The outwardly projecting portion of the cam may be disposed below the surface of the beam when the spring force is overcome by a force manually applied or by a force applied against the ramped face of the cam by a cam engaging pin affixed to a line engaging arm. The line engaging arm has two cam engaging pins adapted to engage the right angle portion of the cam preventing displacement of the cam engaging pin towards the unsupported end of the beam in a cam engaged position, and upon the ramped portion of the cam in a cam depressing position.

As the line slacks, the arm pivots about one cam engaging pin which is in the cam engaged position. The other pin may be in the cam engaged position, the cam depressing position, or in an intermediate position therebetween. The longitudinal axis of the arm is at a variable angle to the longitudinal axis of the beam dependent upon the amount of applied force from the line that is tensioned by the device disclosed herein. This angular relationship changes as the arm pivots about any initially engaged cam engaging pin and the cam surface to which it is engaged. The other cam engaging pin is free to move from the engaged position on a cam in the other row of cams to a newly encountered cam more closely situated to the supported end of the beam. When the other cam engaging pin is sufficiently moved by the angular displacement of the arm to contact the ramped surface of the newly encountered cam, an inwardly applied force is exerted upon the ramped face of the newly encountered cam such that the cam engaging pin traverses past the newly encountered cam and locks into the cam engaged position. The next slackening of the line permits the initially engaged cam engaging pin to traverse past a cam in the same row more closely situated to the supported end of the beam. In this manner, the arm changes its angular relationship to the beam in response to slackening and tightening of the line and automatically adjustably moves from cam to cam towards the supported end of the beam. The arm may be manually displaced in either direction along the beam's length by a simple uni-directional force applied to the arm pulling it towards the supported end of the beam automatically overcoming the spring forces traversing cams in the process and thereby tightening the line, or if preferred, by manual depression of the ramped faces of the cams allowing the arm to traverse towards the unsupported end of the beam thereby slackening the line.

Now referring to the Figures, and more particularly to the embodiment illustrated in FIG. 1 showing an eye hook 1 fixedly secured to a supporting structure 2 and passing through a hole 6 in the beam 7. A portion of cams 8 projects outwardly from uppermost edge 9 of beam 7 and a portion of cams 10 projects outwardly from the lowermost edge 11 of beam 7. Arm 12 is adapted with cam engaging pins 13 and 14 shown engaging an uppermost and lowermost cam. A pulley 15 is pivotably secured to arm 12 about a pivot axis 16. Line 17 is similarly secured to a pully 18 having a pivot axis 19 that is fixedly secured to a vertical supporting surface 20 by a supporting element 21. The line 22 passing through cam engaging pins 13 and 14 forms an angle 23 with the line 24, representing the longitudinal axis of the beam 7. As the tension in line 17 slackens, arm 12 pivots about cam engaging pin 14 in the direction of arrow 25, enabling cam engaging pin 13 to engage and lock to cam 8''. At this time, line 22 assumes a position represented by line 26 which forms an angle 27 with line 24. Alternate slackening and tightening of line 17 allows cam engaging pin 14 to engage cam 10' at which time line 22 forms an angle 23 with line 24.

Figure 2:
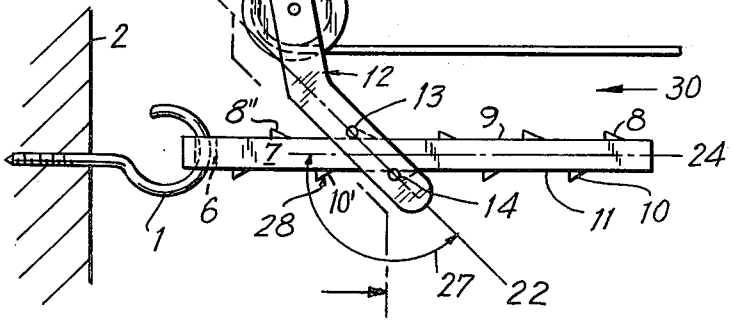
FIG. 2 is a front elevation view depicting the line tensioning device secured to a fragmentary portion of an endless line.

FIG. 2 shows arm 12 in a position where line 22 forms an angle 27 with line 24. Line 17 when slackened enables cam engaging pin 14 to automatically depress the ramped surface 28 of cam 10' inwardly allowing cam engaging pin 14 to engage and lock to the lefthand portion of cam 10' as arm 12 pivots around cam engaging pin 13 in the direction of arrow 29. A force manually applied to arm 12 in the direction of arrow 30, enables cam engaging pins 13 and 14 to engage, if desired, cams 8'' and 10' respectively.

Figure 3:
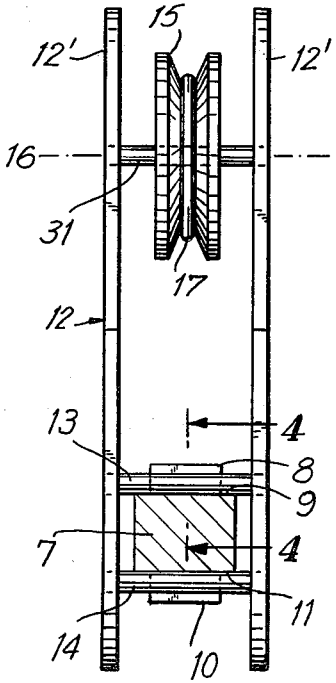
FIG. 3 is a cross-sectional side elevation view taken along line 3—3 viewed in the direction of arrows 3—3 as shown in FIG. 2.

FIG. 3 illustrates side plates 12' forming arm 12 as shown in FIGS. 1 and 2. Axle 31 provides a pivot axis 16 for pulley 15 shown engaging endless line 17. Cam engaging pins 13 and 14 are shown engaging a cam 8, projecting upwardly from the uppermost edge 9 of beam 7 and a cam 10 projecting downwardly outwardly from the lowermost edge 11 of beam 7.

Figure 4:
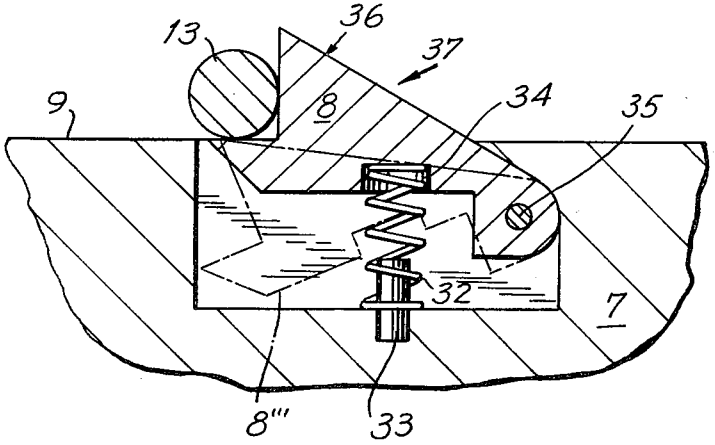
FIG. 4 is a cross-sectional view taken along line 4—4 viewed in the direction of arrows 4—4 as shown in FIG. 3 showing a partial front elevation view of a cam and spring construction.

FIG. 4 illustrates a cam 8 shown engaging cam engaging pin 13 in the cam engaging position. Helical spring 32 engages pin 33 at one end and is seated at the other end within a recess 34 in the lowermost surface of cam 8. Pin 33 is secured to the floor of a recess in beam 7 whose dimensions enable cam 8 to be enclosed therewithin in a position depicted by dotted lines 8''' when cam 8 is pivoted about a cam pivot axle 35 by a force exerted on the ramped surface 36 of cam 8 in the direction of arrow 37.

Figure 5:
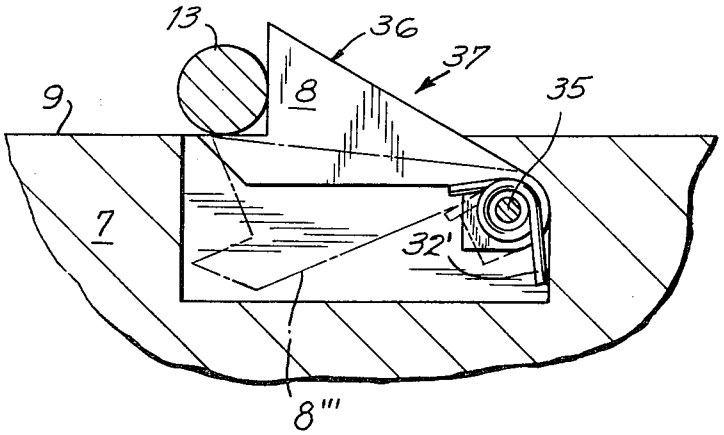
FIG. 5 is a cross-sectional view taken along line 5—5 viewed in the direction of arrows 5—5 as shown in FIG. 3 showing a partial front elevation view of an alternate embodiment of a cam and spring construction.

FIG. 5 depicts cam 8 shown with its ramped surface 36 exposed above the uppermost edge 9 of beam 7 by the forces created by spirally wound spring 32' whose free ends co-act with the lowermost surface of cam 8 and the wall of the cam accepting recess in beam 7. Cam '''', shown in dotted lines, illustrates the position assumed by cam 8 when a force applied in the direction of arrow 37 permists cam 8 to pivot about axle 35 overcoming the outwardly extending forces created by spring 32'.

Figure 6:
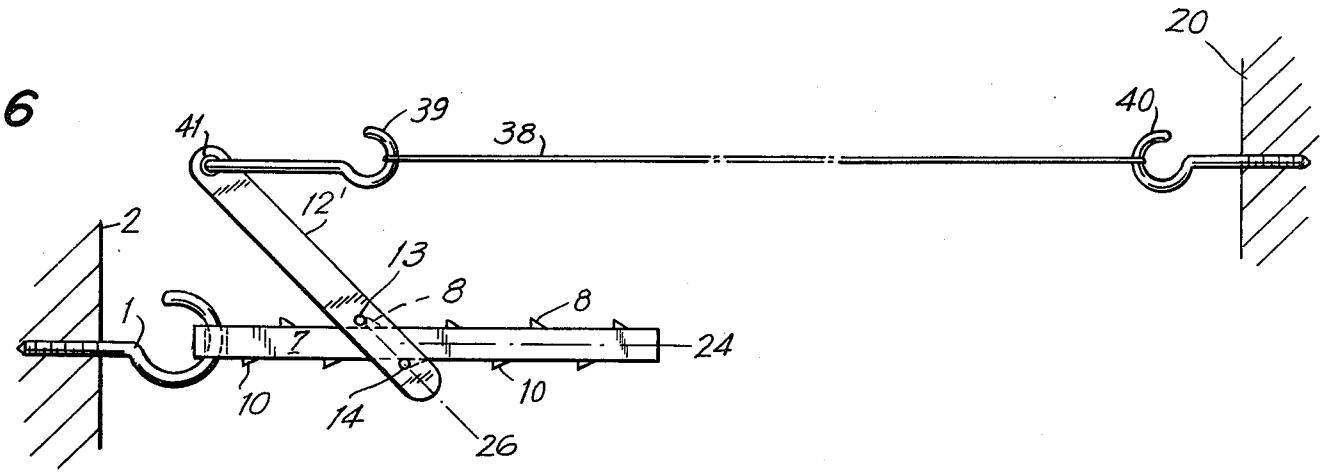
FIG. 6 is a front elevation view of the line tensioning device illustrating a single line shown secured between two spaced apart supported structures.

FIG. 6 illustrates a straight line 38 supported between vertical supporting surfaces 2 and 20 engaging hooks 39 and 40 at the free ends thereof. Arm 12' is adapted to engage beam 7 utilizing cam engaging pins 13 and 14 in the same fashion as described in FIG. 1. Hook 39 pivots at one end about a hole 41 located adjacent the uppermost free end of arm 12' as line 26 changes its angular relationship with line 24 due to the pivoting of arm 12' about cam engaging pin 13 shown in the engaged position with cam 8.

One of the advantages is a line tensioning device which automatically takes up the slack in a line whose length varies due to thermal expansion and contraction or a change in other load forces exerted upon the line.

Another advantage is a line tensioning device which can be manually operated to tighten the line utilizing a single force applied in a single direction.

Still another advantage is a line tensioning device which can be utilized with endless lines as well as securing the free end of a single line.

Yet another advantage is a line tensioning device which can be operated to release line tension without requiring tools.

A further advantage is a line tensioning device which allows the line engaging arm thereof to apply ever increasing line tensioning forces by automatic relocation of the arm along the supporting beam portion thereof dependent upon line tautness.

Another advantage is a line tensioning device which can be operated manually to increase line tautness without the need for tools.

Still another advantage is a line tensioning device which is adapted to have the line engaging portion fastened to the line independent of the supporting portion thereof.

Thus, there is disclosed in the above description and in the drawings, and embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

I claim:

1. A line tensioning device comprising a beam, first and second rows of uniformly spaced cams, said cams within said first and second rows being disposed in a plane parallel to the longitudinal axis of said beam, said first and second rows of cams being disposed in spaced apart relationship, biasing means for urgingly extending a portion of each of said cams outwardly from said longitudinal axis, said outwardly extending portion of each of said cams in said first row extending in a direction opposite from said outwardly extending portion of each of said cams in said second row, beam securing means for fastening one end of said beam to a supporting structure, an arm having a pair of distantly spaced pins fixedly secured thereto, said pins being capable of engaging said portions of adjacent cams in said first and said second rows, line securing means for securing a portion of a line to said arm, said outwardly extending portions of said cams preventing said pins from longitudinal displacement towards the other end of said beam upon engagement of said pins with said outwardly extending portions, and means for overcoming said biasing means capable of displacing said outwardly extending portions inwardly for preventing engagement of said pins with said outwardly extending portions of said cams.

2. The line tensioning device as claimed in claim 1, wherein said each of said cams comprise a ramped surface extending outwardly from the surface of said beam having the outermost projection thereof disposed towards said one end of said beam.

3. The line tensioning device as claimed in claim 2, further comprising a pair of spaced apart and parallel plates straddling said beam therebetween, the ends of said pins being fixedly secured to said plates, cam housing recesses disposed inwardly from opposing surfaces of said beam at the location of each of said cams within said first and said second rows, said cam housing recesses having at least two walls perpendicular to said longitudinal axis of said beam and said opposing surfaces of said beam, said cams within said first and said second rows pivotably secured along a pivot axis perpendicular to said walls, said outwardly extending portions of each of said cams within said first and said second rows capable of extending outwardly from said cam housing recesses, restraining means for limiting the outward extension of said outwardly extending portions of each of said cams within said first and said second rows.

4. The line tensioning device as claimed in claim 3, further comprising a pulley pivotably secured to said arm along a pulley pivot axis extending perpendicular to said plane, and said pulley being capable of engaging a portion of said line.

5. The line tensioning device as claimed in claim 3, further comprising a rod pivotably secured at one end to said arm, and said rod having an eye formed at the other end thereof capable of engaging said line.

6. The line tensioning device as claimed in claim 1, wherein said biasing means comprises a helical spring having one end thereof engaging said beam, and the other end of said helical spring engaging said cam for urging a portion thereof outwardly from said longitudinal axis.

7. The line tensioning device as claimed in claim 6, further comprising cam housing recesses disposed inwardly from opposing surfaces of said beam at the location of each of said cams within said first and said second rows, said cam housing recesses having at least two walls perpendicular to said longitudinal axis of said beam and said opposing surfaces of said beam, said cams within said first and said second rows pivotably secured along a pivot axis perpendicular to said walls, said helical spring pivotably secured about said pivot axis.

8. The line tensioning device as claimed in claim 1, wherein said biasing means comprises a spirally wound spring having one end thereof engaging said beam, the other end of said spring engaging said cam for urging a portion thereof outwardly from said longitudinal axis.

9. The line tensioning device as claimed in claim 8, further comprising a circular recess in said cam, said circular recess engaging the other end of said spring, cam housing recesses disposed inwardly from opposing surfaces of said beam at the location of each of said cams within said first and said second rows, said cam housing recesses having at least two walls perpendicular to said longitudinal axis of said beam and said opposing surfaces of said beam, said cams within said first and said second rows pivotably secured along a pivot axis perpendicular to said walls, said cam housing recesses having at least one surface perpendicular to said walls of said cam housing recesses, a spring retaining pin fixedly secured to said surface of said cam housing recesses, said spring retaining pin engaged within said one end of said spring.

10. The line tensioning device as claimed in claim 1, wherein said line securing means comprises a pulley pivotably secured to said arm along a pivot axis extending perpendicular to said plane, and said pulley being capable of engaging a portion of said line.

11. The line tensioning device as claimed in claim 1, wherein said line securing means further comprises a rod pivotably secured at one end to said arm, and said rod having an eye formed at the other end thereof capable of engaging said line.

12. The line tensioning device as claimed in claim 1, wherein said arm comprises a pair of spaced apart and parallel plates straddling said beam therebetween, and the ends of said pins being fixedly secured to said plates.

13. The line tensioning device as claimed in claim 1, wherein said line comprises an endless line.

14. The line tensioning device as claimed in claim 1, wherein said line comprises a free end of a line.

15. The line tensioning device as claimed in claim 1, wherein said beam securing means comprises an opening formed in said one end of said beam adapted to receive one end of a beam supporting element, the other end of said beam supporting element being fixedly secured to said supporting structure.

16. The line tensioning device as claimed in claim 1, comprising cam housing recesses disposed inwardly from opposing surfaces of said beam at the location of each of said cams within said first and said second rows, said cam housing recesses having at least two walls perpendicular to said longitudinal axis of said beam and said opposing surfaces of said beam, said cams within said first and said second rows pivotably secured along a pivot axis perpendicular to said walls, said outwardly extending portions of each of said cams within said first and said second rows capable of extending outwardly from said cam housing recesses, restraining means for limiting the outward extension of said outwardly extending portions of each of said cams within said first and said second rows.

17. The line tensioning device as claimed in claim 16, wherein said restraining means comprises another wall in each of said recesses having a surface parallel to said pivot axis, each of said cams within said first and said second rows engaging a portion of said another wall limiting the outward extension of said outwardly extending portions thereby.

18. The line tensioning device as claimed in claim 1, wherein said distantly spaced pins are spaced a distance apart sufficient to enable one of said pins to pivot about one of said cams in said first row as the other of said pins is disposed arcuately between two adjacent cams in said second row of cams, said one of said cams disposed on a projection extending perpendicularly from a point midway between said two adjacent cams.

* * * * *